United States Patent [19]

Bjorksten et al.

[11] 3,941,182

[45] Mar. 2, 1976

[54] CONTINUOUS PROCESS FOR PREPARING UNIDIRECTIONALLY REINFORCED METAL FOAM

[75] Inventors: Johan Bjorksten, Madison; Edward J. Rock, Blue Mounds, both of Wis.

[73] Assignee: Johan Bjorksten, Madison, Wisconsin

[22] Filed: July 31, 1973

[21] Appl. No.: 384,295

Related U.S. Application Data

[63] Continuation of Ser. No. 193,744, Oct. 29, 1971, abandoned.

[52] U.S. Cl. ..... 164/86; 164/87; 164/79; 75/20 F; 29/191; 29/196.2; 29/197; 164/275; 164/278

[51] Int. Cl. ..... B22d 11/06

[58] Field of Search ..... 75/20 R, 20 S, 20 F; 29/191.2, 191.4, 191.6, 196.2; 164/78, 79, 275, 86

[56] References Cited

UNITED STATES PATENTS

| | | | |
|---|---|---|---|
| 275,408 | 4/1883 | Philips et al. | 164/275 |
| 867,659 | 10/1907 | Hoopes et al. | 29/196.2 X |
| 2,849,790 | 9/1958 | Zwicker | 29/196.2 |
| 2,937,938 | 5/1960 | Fiedler et al. | 75/20 |
| 3,005,700 | 10/1961 | Elliott | 75/20 |
| 3,126,595 | 3/1964 | Dewey et al. | 164/79 |
| 3,306,716 | 2/1967 | Adler | 29/196.2 |
| 3,733,382 | 5/1973 | Van Dijk | 425/817 |
| 3,756,303 | 9/1973 | Valdo | 164/98 |

FOREIGN PATENTS OR APPLICATIONS

| | | | |
|---|---|---|---|
| 615,147 | 10/1926 | France | 75/20 F |
| 901,917 | 7/1962 | United Kingdom | 164/278 |

*Primary Examiner*—Francis S. Husar
*Assistant Examiner*—Vernon Kilbourn Rising
*Attorney, Agent, or Firm*—John M. Diehl

[57] ABSTRACT

Steel wires are pulled through a reactor tube in which they continuously interact with a foaming metal mass. The steel wires are coated with a metal which forms a binary alloy with the matrix metal, thereby protecting the steel from being dissolved. The foaming matrix metal is usually an aluminum alloy but can be any light or low melting metal including zinc or lead. The steel wires protect the metal foam from cracking in the pultrusion process.

2 Claims, 9 Drawing Figures

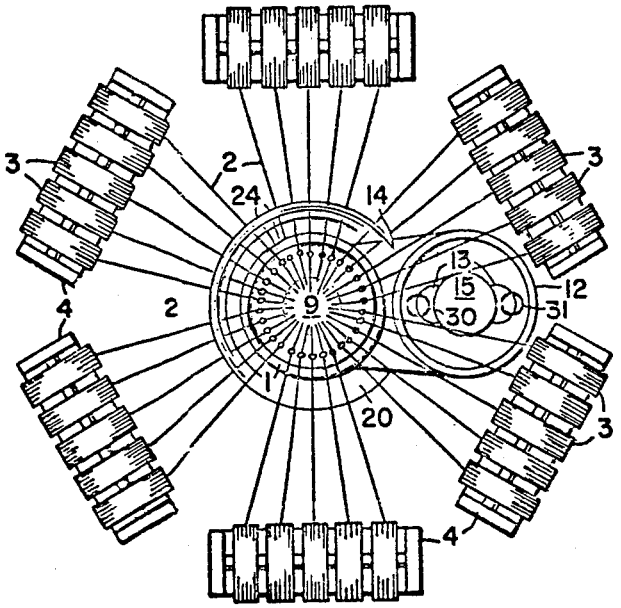
Fig. 2
Fig. 3
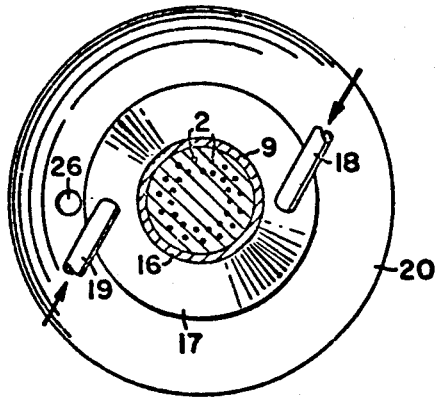
Fig. 4
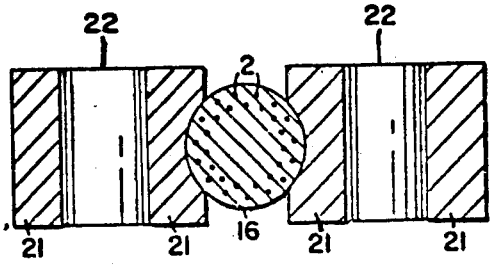

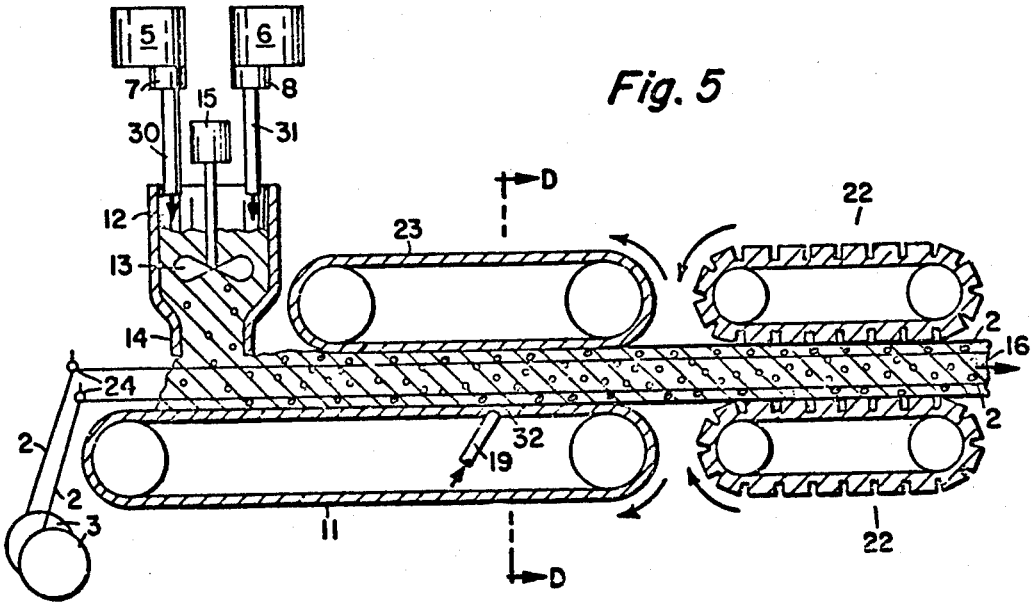
Fig. 5
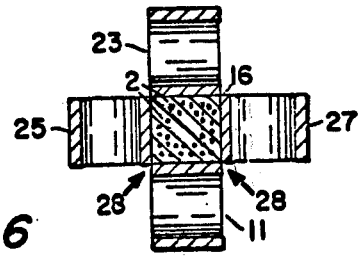
Fig. 6
Fig. 7
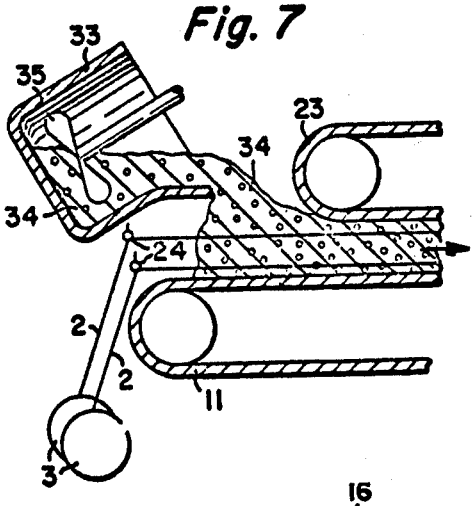
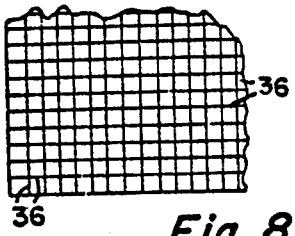
Fig. 8
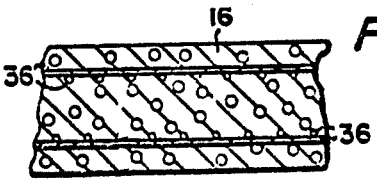
Fig. 9

CONTINUOUS PROCESS FOR PREPARING UNIDIRECTIONALLY REINFORCED METAL FOAM

This is a continuation of application Ser. No. 193,744, filed Oct. 29, 1971 and now abandoned.

PRIOR ART AND BACKGROUND

Continuous production of aluminum foam has been suggested, for example in U.S. Pat. Nos. 2,937,938 and 2,974,034. However, none of these processes has reached the stage of practical operation because in continuous production the extension and contraction due to thermal changes causes the continuously produced metal foam to crack on the surface every few inches. Also, it has not been possible to effectively bond reinforcements in such a way as to secure their adhesion to the metal, nor to introduce them to the metal continuously in an orderly fashion so as to obtain reinforcement of the needed efficacy.

OBJECTS OF THE INVENTION

An object of this invention is to prepare a reinforced metal foam in continuous process.

Another object is a continuous metal article reinforced unidirectionally with steel wire.

Further objects will become apparent as the following detailed description proceeds.

BRIEF STATEMENT OF THE INVENTION

A parallel bundle of wires is being pulled thru sequential hot and cold temperature zones. In its course it is surrounded with a foaming mixture of a matrix metal and a suspension of foaming agent (preferably a metal hydride) in a low melting alloy miscible therewith. The foam and the wire bundle interact so that the bundle prevents the cracking of the foam to which it has become firmly bonded for example by the formation of a binary compound. Thus we prevent the cracking of the foam on cooling and pulling which has heretofore presented unconquerable obstacles to the continuous production of foamed metal. The wires introduced serve an additional useful purpose in strengthening the extrusion so that its tensile strength may exceed that of solid aluminum metal, although it contains less than half of its volume of solid metal.

DRAWINGS

In the description of this invention we make reference to drawings of which:

FIGS. 1, 5 and 7 are side schematic views.

FIG. 2 is a top view taken along section line A—A of FIG. 1.

FIG. 3 is a top view taken along section line B—B of FIG. 1.

FIG. 4 is a top view taken along section line C—C of FIG. 1.

FIG. 6 is a view taken along section line D—D of FIG. 6.

FIG. 8 is a top view and FIG. 9 a side view of details.

DETAILED DESCRIPTION OF THE INVENTION

Figure 1:
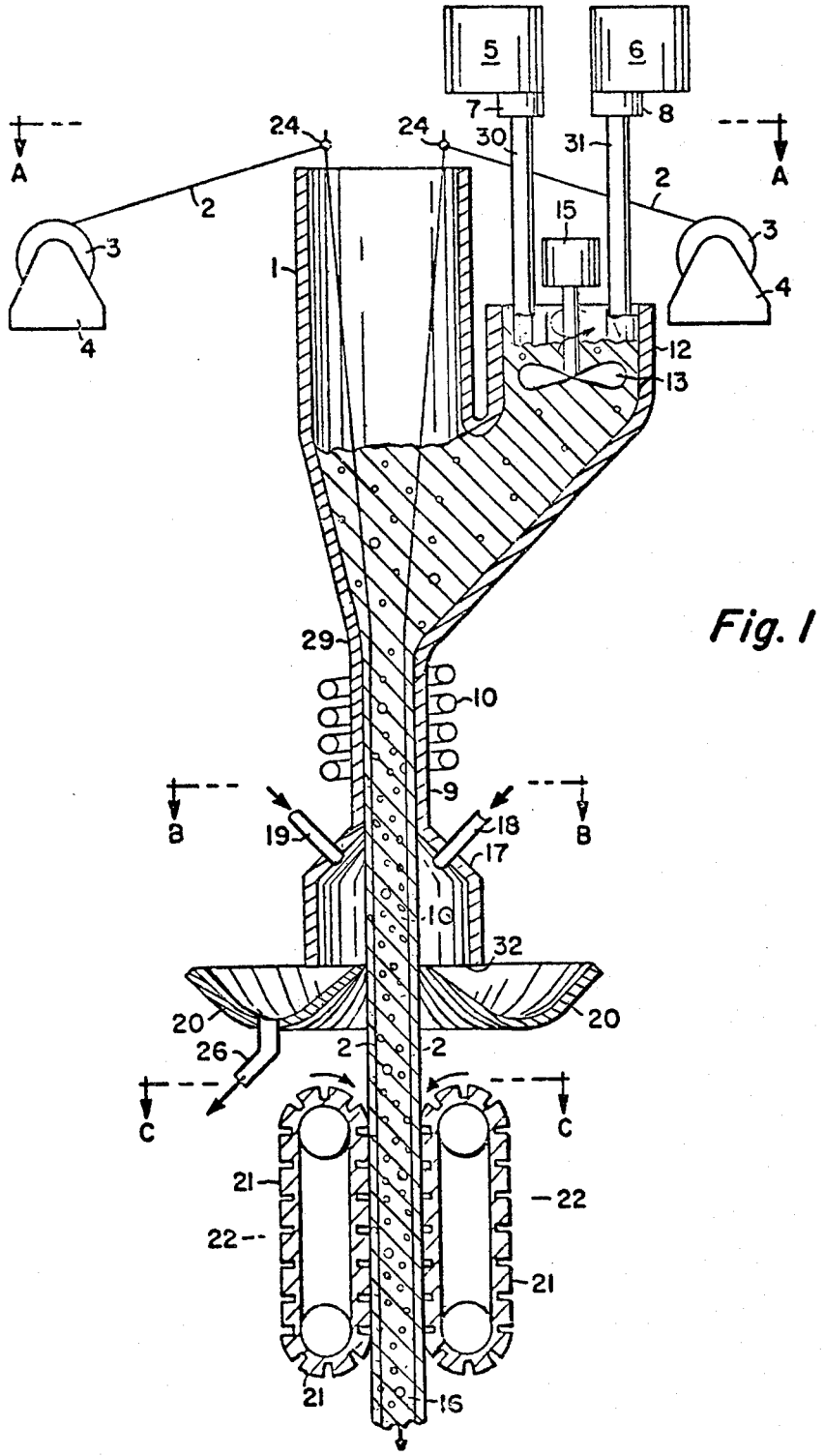

With reference to FIG. 1, 1 is a tubular reactor, vertically positioned, open in both ends. Steel wires 2 are introduced at the top end. They pass over guides 24 which control their spacing and positioning. (Only two wires and two guides are shown in this view for the sake of clarity.) Tensioners (not shown) may be used if necessary to control the tension of these wires. Often, however, the angle at the guides will suffice to maintain the requisite tension.

At a convenient point, usually several feet below the top, at 29, the reactor is constricted so that the reinforcing wires are brought together as closely as it is intended to space them in the final pultrusion. Somewhat above this point we introduce the matrix alloy in which foaming is underway. This foaming alloy is obtained by bringing together a metal stream consisting essentially of a low melting alloy in which a decomposable foaming agent has been well dispersed, at a temperature at which the gas evolving on decomposition of this foaming agent has hardly commenced (tank 5, metering means 7, duct 30) and a matrix alloy, which may optionally contain some dispersed reinforcing fibers (not shown) (tank 6, metering means 8, duct 31).

Ducts 30 and 31 feed their respective streams above described into mixing vessel 12, where they are rapidly commingled by mixer 13, driven by motor 15. The passage and mixing of the streams in 12 takes at the most a few seconds, as the streams mix very readily. The matrix metal stream from tube 31 has a temperature sufficiently high to raise the temperature of the combined streams at least to the decomposition temperature of the foaming agent, so that the foaming begins in the mixer, and proceeds to near completion within the following minute. The foaming can be suppressed by operating the mixer assembly under pressure, so that the foaming occurs only on its release into the reactor; however this is mechanically more complicated and usually not preferred.

The matrix alloy passes from mixing vessel 12 into reactor vessel 1 by means of passage 14. The temperature in the narrowed section 29 of the reactor following the addition of the foaming matrix metal, is controlled by either heating or cooling means 10, in accordance with the requirements for optimizing the foaming of the particular alloy used. Typically, we would use for one of the two streams a composition of 10 percent of titanium hydride dispersed in magnesium - aluminum eutectic alloy, and for the other stream any technical aluminum alloy mainly consisting of aluminum, both at 2°–100° and preferably about 20°C above their respective melting points. The foaming time would then be in the order of magnitude of 20 seconds, and this should be approximately the preferred time for passing these metals from the mixer 12 to the point where the foam has solidified throughout.

At the end of the constricted zone, the reactor widens 17 and a cooling medium is introduced. This impinges on the now congealed article 16, which consists of a structural shape of metal foam, reinforced longitudinally by the steel wires introduced at the top of the reactor, and firmly bonded to the foam by the formation of binary alloys between the foamed metal and the metal coated onto the steel wires, which were formed during the period of their contact with the melted metal. The cross sectional shape of the article formed is usually rounded, but can be chosen at will by correspondingly varying the cross sectional shape at 29.

The cooling medium may be water, or it may be a gas such as air, but we prefer to use a fog of water finely dispersed in a gas. The cooling medium is introduced through pipes 18 and 19. The cooling medium is discharged through the lower opening 32 of the reactor;

if liquid it is collected by the circular collecting means 20 and discharged through gutter means 26.

The article produced is moving into contact with the caterpillar members 22 which grasp it and pull it downward with positive traction. Thus we ensure a continuous, uniform motion of the wires and of the matrix surrounding them. The "feet" 21 of the "Caterpillar" pullers are preferably coated with about ½ inch of an elastomer (not shown) to avoid mechanical damage to the article pulled and to ensure the friction necessary for a firm positive grip.

FIG. 2 is a top view of the machine of FIG. 1. The matrix metal is not shown in this view. It shows the upper rim of the reactor, 1, and, wires 2 moving from the spools 3 positioned on the creels 4 thru the guides 24 through the reactor and its narrowed part 9, where the wires enter and become parallel to the surface of 9. The number and disposition of creels and spools will depend on the geometry of the finished article in each case. FIG. 2 also shows in further detail a top view of the mixer 13 for combining foaming agent and matrix metal.

FIG. 3 shows a section of the reactor just above the point where the coolant is introduced through pipes 18 and 19. It also shows the widened part 17 of reactor 1, with the article produced, in this case a rod, the wires being arranged in concentric circles.

FIG. 4 shows in detail how a cross section of the article 16 is being gripped and propelled by the caterpillar pullers 22.

FIG. 5 shows another embodiments of the invention in which the process is conducted horizontally. Here the early part of the process is essentially as described above, but instead of a tubular reactor we now employ a channel formed between four belts of which two, 11 and 23 are shown in this longitudinal sectional view while the detail view FIG. 6, also shows the two other belts 25 and 27. The article formed in this case is a four sided prism. Obviously articles of different cross section such as H, I or L shape forms can be made by placing moving belts in the corresponding geometries. In the embodiment shown in FIG. 6 the foaming is completed in the channel between the four belts. Since the walls of this channel move at the same speed as the foam and the wires, foam breaking effect due to frictional contacts is wholly avoided. The metal foam is still plastic in the early part of this moving channel, in the latter part it congeals. Coolant may be added at the appropriate point of the belt, for example as a cooling spray on the belts applied at the junctures 28 between the belts about half way in the longitudinal direction of the belt at 32. The resultant reinforced foam 16 may be moved entirely by these belts, or it may in some cases move on to an additional gripping caterpillar pair 22 as those shown in FIG. 1.

The wires may be fed into the process by other suitable means known to the art and the pulling may be done by ratchets, revolving large diameter pulling wheels, metal drawing hydraulic means and the like. Thus we are not confined to the particular means shown in the drawings and explained above by way of illustration.

The wires serve the function of preventing the surface cracks which have heretofore marred all attempts to produce cellular foamed metals in continuous process. In addition they provide a high unidirectional strength.

While we prefer to apply the wire reinforcement close to the surface for maximum bending and flexural strength and rigidity, we may also apply them centrally for maximum fatigue strength, or uniformly throughout the body of the article, particularly in rods and like applications, where tensile strength is the primary consideration.

A further embodiment of the invention is shown in FIG. 7. Here a foam "batter" is made separately in a pot 33 by mixing together 1 lb of titanium hydride prepulverized until it would pass a 325 mesh screen. 9 lbs of aluminum-magnesium eutectic alloy were mixed therewith at 450°C using propeller mixer with inverted pitch 35, made of cast iron, at 200 rpm, to effect thorough dispersal.

90 lbs of aluminum pre-heated to 670°C was then added to the same pot and the agitation continued. A thick batter 34 was formed. This was poured between the horizontal conveyors 11 and 23, either into the bite between these conveyors or onto conveyor 11, which by its motion brought the batter 34 into the space between the two conveyors. A multiplicity of steel wires, coated as described above, is fed into the batter between the rollers. For the sake of clarity, only two of these wires 2 are shown. They will move with the batter, which may be cooled and moved on as a solid reinforced sheet of foamed metal, for example in the manner shown in FIG. 5. The presence of the steel wires in the critical period of cooling, prevents such cracking as would otherwise have rendered this process uncommercial. The unidirectionally tensed steel wires contribute greatly to the longitudinal strength of the resultant sheet.

If desired, a continuous sheet of similarly coated steel gauze 36 may also be fed into the foam when higher transversal strength is required. FIGS. 8 and 9 show this embodiment of the invention.

In the interest of maximizing adhesions between the reinforcing wires and the metal foam, we prefer to have the wires coated with a thin layer of a metal which forms a binary alloy rich in aluminum, by which I mean containing at least 25 percent of aluminum, and which alloy does not dissolve into the foam under the conditions of the process. Particularly suitable for this purpose are coatings of nickel, cobalt, zinc, copper and molybdenum, and their alloys, including brasses. When the wires are coated with even a very thin layer (0.0001 inch and less) of the above metals, and then contacted with an alloy containing liquid aluminum, an article results in which these steel wires are surrounded by a firmly adhered layer or sheath of a binary aluminum alloy not readily soluble in the matrix, and in any event not soluble within the time cycle considered for the processes disclosed above.

We prefer so to dispose the reinforcing wires, that these will be parallel with the nearest surface of the said article, and nearer to said surface than to the longitudinal axis of said article.

Having thus disclosed our invention, we claim,

1. The process of providing a longitudinally elongated body of metal foam having longitudinally extending wires therewithin, said wires being of metal melting higher than the metal of the foam, comprising the combination of the steps of:

1. intensively mixing into molten metal to be foamed a substance which decomposes and liberates gas when heated, and 2. heating said substance to decompose it while it is immersed in said molten metal to produce molten metal foam with heat by conduction from said molten metal,
3. moving said molten metal foam longitudinally to provide a longitudinally moving body of molten metal foam,
4. providing said longitudinally moving body of molten metal foam between a plurality of longitudinally moving surfaces of endless metal belts contacting said longitudinally moving body of molten metal foam,
5. providing a plurality of metal wires of metal melting higher than the metal of said foam, said wires having surfaces disposed to adhere to the metal of said foam, 6. moving said wires longitudinally to introduce said wires longitudinally into said longitudinally moving body of molten metal foam with said wires moving longitudinally at the same longitudinal rate as the rate of longitudinal movement of said longitudinally moving body of molten metal foam.
7. cooling said longitudinally moving body of metal foam containing said wires to provide said longitudinally elongated body.

2. The process of claim 1 characterized by providing said wires of steel and coating said wires with brass before introducing the wires into said longitudinally moving body of molten metal foam.

* * * * *